US006367607B1

(12) United States Patent
Bolen

(10) Patent No.: US 6,367,607 B1
(45) Date of Patent: Apr. 9, 2002

(54) DROP OUT COIN MECHANISM FOR VENDING MACHINE

(76) Inventor: Richard K. Bolen, 4000 Club House Dr., Champaign, IL (US) 61821

( * ) Notice: Subject to any disclaimer, the term of this patent is extended or adjusted under 35 U.S.C. 154(b) by 0 days.

(21) Appl. No.: 09/519,906

(22) Filed: Mar. 7, 2000

(51) Int. Cl.[7] ..... G07F 9/10; G07F 11/16
(52) U.S. Cl. ..... 194/350; 221/232
(58) Field of Search ..... 194/350; 221/226–232

(56) References Cited

U.S. PATENT DOCUMENTS 4,679,684 A * 7/1987 Glaser ..... 194/350
5,335,822 A * 8/1994 Kasper ..... 221/232
5,911,763 A 6/1999 Quesada
5,996,841 A * 12/1999 Marrocco ..... 221/232

* cited by examiner

*Primary Examiner*—Robert P. Olszewski
*Assistant Examiner*—Bryan Jaketic

(57) ABSTRACT

A vending machine includes a partitioned front panel section including a drop out coin slot assembly. The partitioned front section includes an intermediary bracket that is carried on a cabinet of the vending machine. The intermediary bracket has one or more depending blades. A coin slot assembly includes one or more coin receiving mechanisms attached thereto. A backside of a major bracket of the coin slot assembly defines one or more gaps to capture each of the depending blades of the intermediary bracket. The coin slot assembly is placed in an opening of the vending machine front panel and moved so that the blades of the intermediary bracket are engaged by and received in the gaps of the coin slot assembly. A front cover panel has a locking mechanism and is secured over a remaining open portion of the front panel. The front panel cover includes one edge that engages a portion of the cabinet and is then pivoted into place and secured by a three point locking mechanism. Interior stacks of a dispensing hopper assembly of the vending machine include stack weights having a hook thereon that can be gripped to remove the stack weights when refilling the stacks and which can be hooked to a portion of the vending machine while preforming a refill repair service.

20 Claims, 7 Drawing Sheets

DROP OUT COIN MECHANISM FOR VENDING MACHINE

BACKGROUND OF THE INVENTION

1. Field of the Invention

The present invention relates generally to vending machines, and more particularly to a vending machine with a coin slot mechanism that easily drops out from the front of the machine without requiring major disassembly of the machine.

2. Description of the Related Art

Vending machines are known in the art. Vending machines for dispensing products that utilize a coin slot mechanism at the front of the machine are also known. These types of vending machines are typically used to dispense many different kinds of products including toys, candies, and even stickers that resemble playing or trading cards. All of these machines require insertion of coins into a coin slot mechanism or a number of mechanisms in the front of the machine prior to retrieving an object from the interior of the machine. The coin slot mechanisms typically are carried by a front panel of the machine and have a slidable section that can be pushed inward into the machine for delivering money to an interior collector of the machine.

It is known that the coin slots of the mechanisms can easily become clogged or jammed due to a number of causes. One such cause is placement of objects other than coins in the slots and then pushing the sliding section into the interior of the machine. The sliding section can become jammed or stuck in the machine or can become damaged depending upon the type of object placed in the coin slot. Coins can also be placed in the slots that are themselves damaged which can also cause damage to the coin slots or can jam the sliding section of the coin slot mechanism.

On current machines, it is difficult to repair and/or replace these coin slot mechanisms. The coin slot mechanisms are affixed to the front panel of the machine or to a portion of the machine that is not easily removable. Substantial disassembly of the vending machine must take place in order to work on or replace a coin slot mechanism.

One type of vending machine dispenses stickers or playing cards or the like that are vertically stacked in one or more tubes held within the machine. A stack weight is placed over the top of the stack of objects within the tube. The weight continues to press downward on the stack in order to keep the product dispensing at the bottom of the stack according to the design of the machine. These weights are typically not easy to remove from the stacks when a machine is being refilled or serviced. Additionally, these weights sometimes become misplaced when working on the machine or refilling the stacks with a dispensable product.

SUMMARY OF THE INVENTION

One object of the present invention is to provide a modular construction for a vending machine in order to simplify disassembly. Another object of the present invention is to provide a vending machine wherein a coin slot mechanism can be easily removed without disassembling the rest of the machine. A further object of the present invention is to provide a vending machine that includes a coin slot mechanism that can be completely replaced with only minimal disassembly of the rest of the machine. A further object of the present invention is to provide a vending machine that permits easy access into the interior of the machine to retrieve a coin collection basket with only minimal disassembly of the remainder of the machine. A still further object of the present invention is to provide a vending machine that includes a securable and removable front cover panel that utilizes a three point locking mechanism to permit easy access to the interior of the machine. Yet another object of the present invention is to provide a stack weight that can be easily handled while it remains within product stack of the machine. A further object of the present invention is to provide a vending machine including a stack weight that can be removably secured and held by a portion of the machine while refilling the machine with dispensable product.

These and other object, features, and advantages of the present invention are provided by a vending machine of a relatively modular construction. In one embodiment, a vending machine of the present invention includes a segmented front panel assembly including a front cover panel that is removably secured to a portion of an opening of the machine. In one embodiment, this front cover panel section includes a three point locking mechanism for securing the front cover panel to a lower front opening of the machine.

In one embodiment, a coin slot assembly includes at least one coin slot mechanism. The coin slot mechanism is secured to a major bracket panel section by one of more mounting brackets attached to a back side of the major bracket. Each of these brackets defines a gap between a portion of the mounting bracket and the back side of the major bracket. An intermediary bracket is also received in the front opening of the machine. The intermediary bracket in one embodiment is carried by the vending machine in this front opening. The intermediary bracket includes one or more blades that extend generally parallel to the front of the machine. A portion of each blade is received in a corresponding one of the gaps defined by the mounting brackets. When installed, the coin slot assembly is placed within a portion of a front opening of the vending machine and then moved toward the intermediary bracket so that the blades are each received within a corresponding gap. The coin slot assembly and the intermediary bracket are then forced together and secured to one another in this manner. The front cover panel then covers the remaining portion of the opening of the vending machine and can be secured in place by manipulating the three point locking mechanism.

To remove the coin slot assembly or to provide access to a coin collecting basket within the interior of the vending machine, the front cover panel is removed by manipulating the three point locking mechanism and then removing the front cover panel from the vending machine. The coin collecting basket can be removed through the opening provided by removal of the front cover panel. In addition, the coin slot assembly can be removed by simply "dropping out" or separating the coin slot assembly from the intermediary bracket which is carried by the vending machine. This is done by moving the major bracket of the coin slot assembly away from the intermediary bracket so that the blades can be removed from their corresponding gaps between the mounting brackets and major bracket. The coin slot mechanism and the attached major bracket can then be removed from the vending machine.

In one embodiment, the vending machine includes at least a pair of the coin slot mechanisms wherein each of the mechanisms is secured to the major bracket by separate mounting brackets. The mounting brackets each have distal ends with flanges that are spaced from the major bracket back side forming one of the gaps on each mounting bracket distal end. Each of the brackets has one flange that faces a flange on the other bracket defining a slot between the two mounting brackets. A central blade section extending from the intermediary bracket includes side edges that are captured by these opposed flanges of the mounting brackets. The intermediary bracket also includes a pair of flanking blade sections having edges that are received in the gaps formed between the outer, opposite flanges of the mounting brackets and the back side of the major bracket.

In one embodiment, a cotter pin is removably received through openings in a pair of corresponding upturned tabs, one carried on the major bracket and one carried on the intermediary bracket. The cotter pin secures the coin slot assembly in place when assembled to the intermediary bracket.

In one embodiment, the front cover panel includes a flange on an edge that is received on a corresponding and mating lip carried by a portion of the vending machine adjacent the front opening. The front cover panel is installed by first placing the flange over the lip and then pivoting the front cover panel about the edge carrying the flange until the panel is flush with the front of the vending machine. The three point locking mechanism is then manipulated so that a protruding lug or latch of each point of the locking mechanism is received behind or within a corresponding striker on the machine in order to secure the front cover panel to the vending machine.

In another embodiment of the invention, the vending machine includes at least one vertically orientated elongate tube or stack for receiving a plurality of vertically stacked dispensable products therein. A stack weight is removably received within the stack for placement on top of the stacked products. The stack weight includes a top surface with an upwardly projecting finger having a right angle flange extending from the top edge of the finger. In order to remove the stack weight from the stack, a user simply grabs the finger and flange and lifts the stack weight from the stack. The finger and flange are orientated in such a manner that the stack weight can be hung on an edge of the machine or an edge of the stack during repair of the machine or refilling of the stack with a dispensable product.

These and other objects, features and advantages of the present invention will become apparent upon a review of the detailed description herein and the accompanying drawing figures. Specific embodiments of the present invention are shown and described herein although the invention is not to be limited to such embodiments. The disclosed and illustrated embodiments are provided for illustration of the invention and not in any way to limit the scope of the invention.

DETAILED DESCRIPTION OF THE PREFERRED EMBODIMENTS

Figure 1:
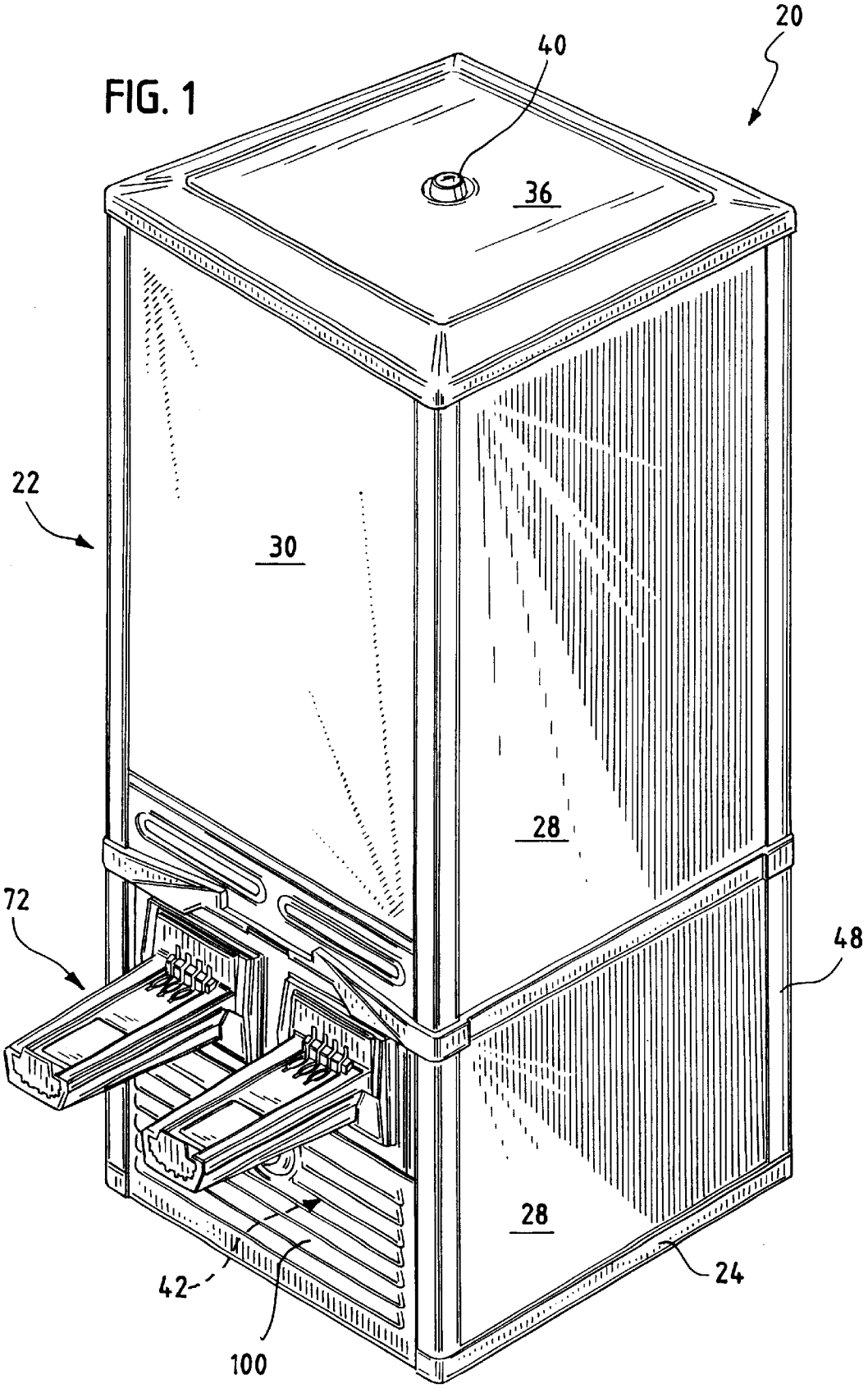
FIG. 1 illustrates a perspective view of an assembled vending machine constructed in accordance with one embodiment of the present invention.
Figure 2:
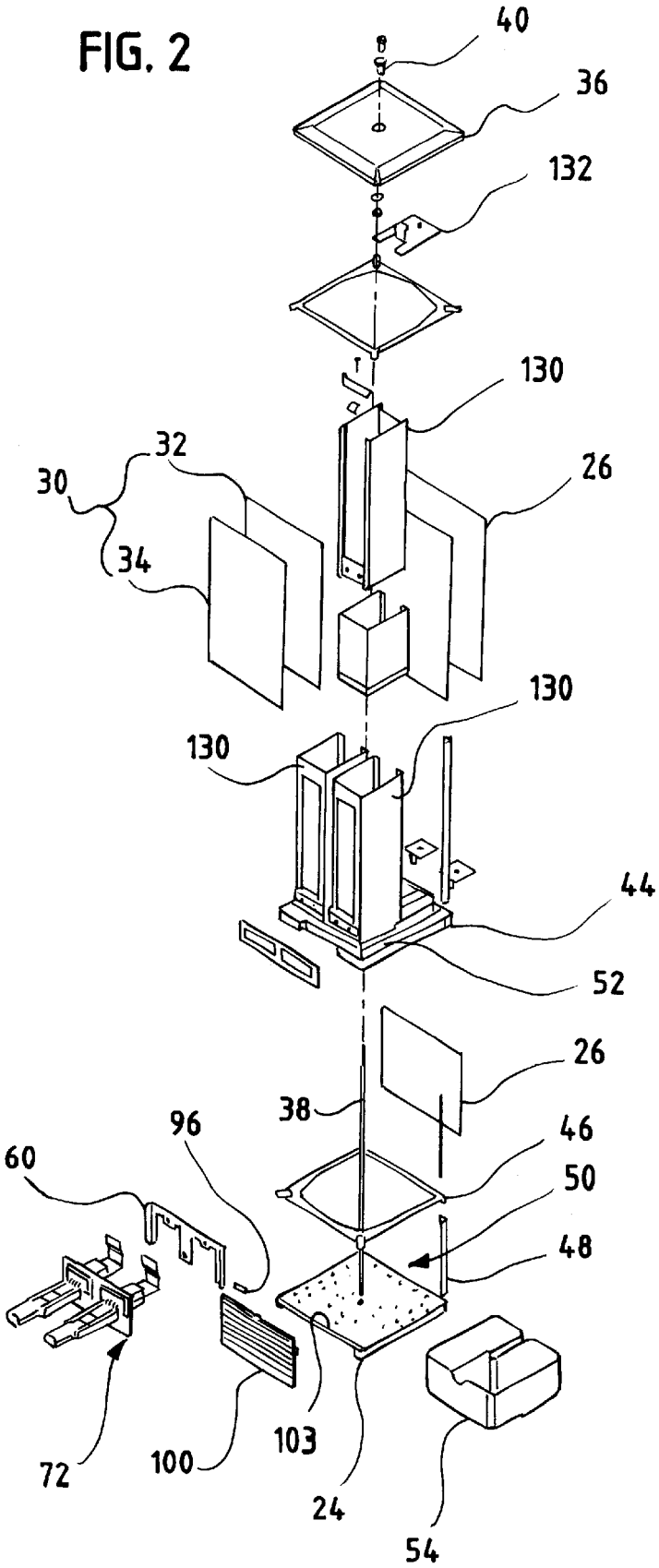
FIG. 2 illustrates an exploded view of the vending machine of FIG. 1

Referring now to the drawings, FIGS. 1 and 2 illustrate a perspective view as assembled (FIG. 1) and exploded view (FIG. 2) of a vending machine 20 constructed in accordance with one embodiment of the present invention. The vending machine 20 generally includes a cabinet 22 formed of modular components. The cabinet 22 includes a bottom panel 24, an upstanding back panel 26 and a pair of upstanding side panels 28 arranged generally perpendicular to the back panel 26. The vending machine 20 also includes a partitioned front panel including an upper front panel section 30 having an inner section 32 and an outer clear section 34. The outer section can be made of glass or plexiglass so that objects within the vending machine can be placed between the inner section 32 and the outer section 34 so that users of the machine can determine what is being sold from within the vending machine. The back panel and/or side panels can also be constructed in such a manner. One or more of the panels can alternatively be clear, permitting visual inspection of the machine interior.

The vending machine 20 also generally includes a top cover panel 36 that closes a top opening of the cabinet 22. An elongate central rod 38 extends upward from the bottom panel 24 to the top opening of the cabinet 22. The top cover panel 36 can include a locking mechanism 40 that is key actuated and that will threadingly secure the top cover panel to the threaded rod 38 to securely assemble the cabinet 22.

The cabinet 22 also includes a lower front opening 42 providing access into an interior of the cabinet 22. A product hopper assembly 44 is received within the interior of the cabinet and is spaced from the bottom panel 24 by an intermediate support bracket 46 that is supported on columns 48 above the bottom panel.

An interior lower space 50 is defined between the bottom panel 24 and a floor assembly 52 of the hopper assembly 44. A coin receiving basket 54 is removably received within the lower interior space 50 and can be removed through the lower front opening 42 of the cabinet 22.

A novel aspect of the present invention is in the assembly of the lower front partitioned panel sections that cover the lower front opening 42 of the cabinet. These lower front panel sections include an intermediary bracket 60 that is captured between a front pair of the columns 48 and the intermediate support bracket 46. The intermediary front section bracket 60 is therefore held securely to the cabinet 22 but may float upward somewhat from its normal rest position. The intermediary bracket 60 can include an upper in-turned flange that rests on top of the support bracket 46 providing a vertical positioning mechanism for the intermediary bracket and preventing the intermediary bracket from dropping lower than its intended position.

The intermediary bracket 60 includes a central depending blade section 62 extending from a transverse beam 64 of the bracket from which the flange 61 also extends. A pair of outer blade sections 66 extend downward from the opposite side edges of the transverse beam 64. The outer blade sections 66 include at least an inner edge that is a flat planar blade 68. The outer edge of the outer blade section 66 can include structural ribs 69 for strengthening the intermediary bracket. Similarly, the central blade section 62 has a pair of side edges that are flat planar blades 70. The remaining portion of the central blade section 62 can also include strengthening ribs if desired.

Figure 3A:
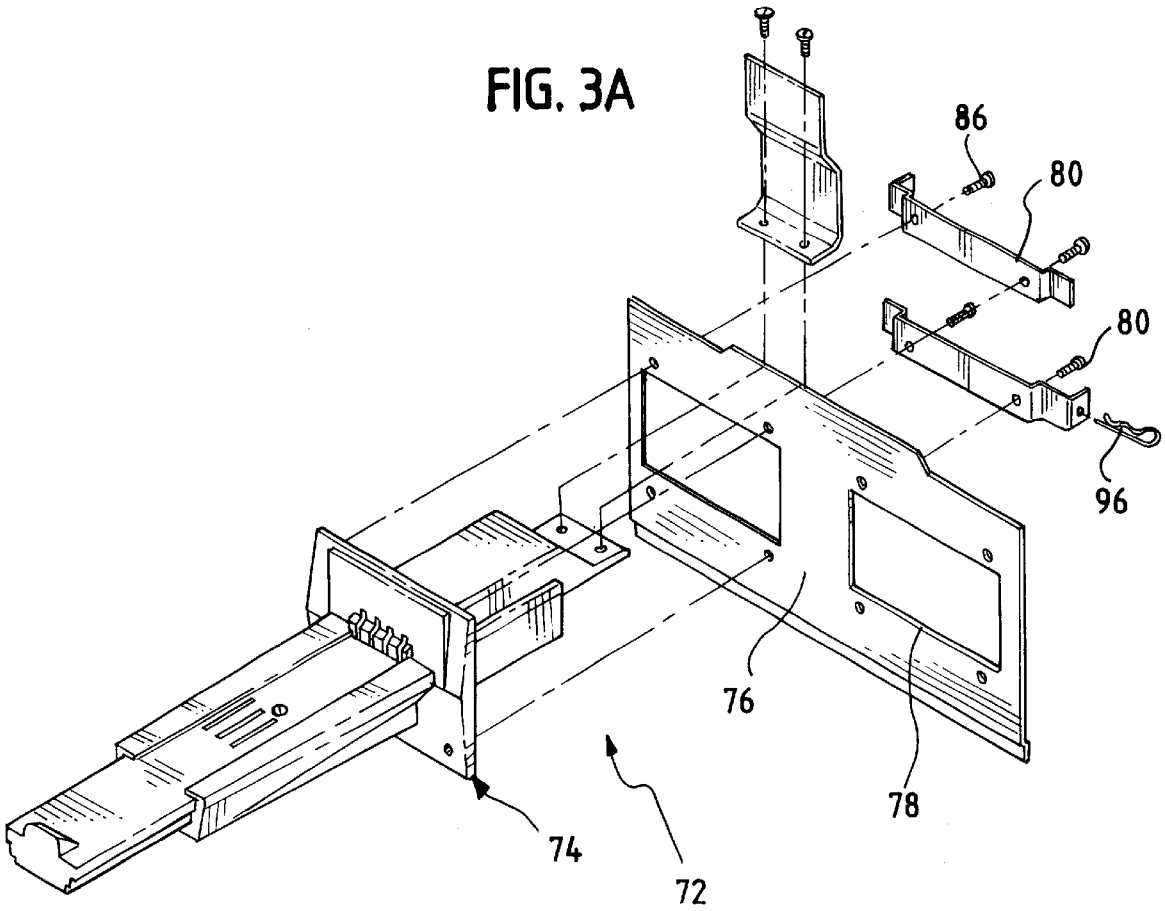
FIGS. 3*a* and 3*b* illustrate enlarged exploded views of the coin slot assembly of the machine of FIG. 1.
Figure 3B:
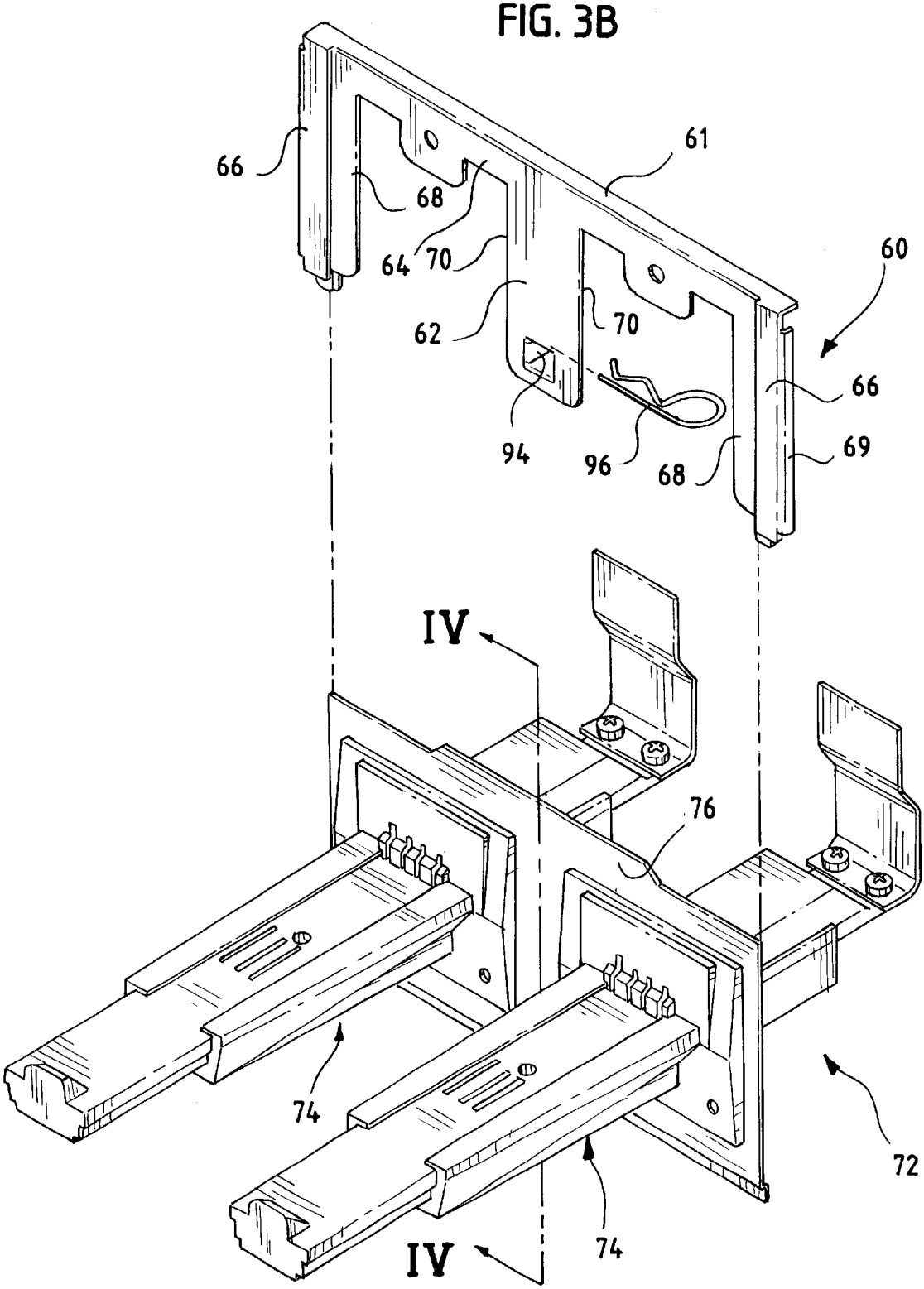
Figure 4:
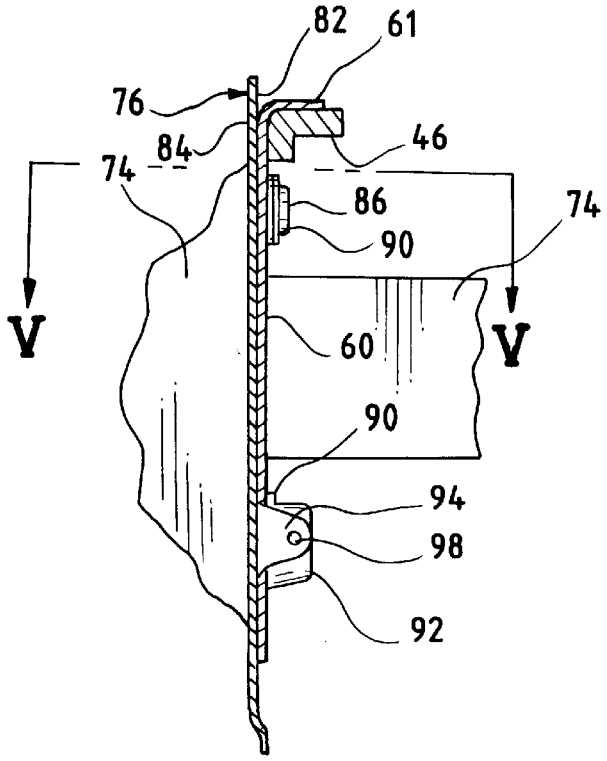
FIG. 4 illustrates a cross section taken along line IV—IV of FIG.3 when the components are assembled.
Figure 5:
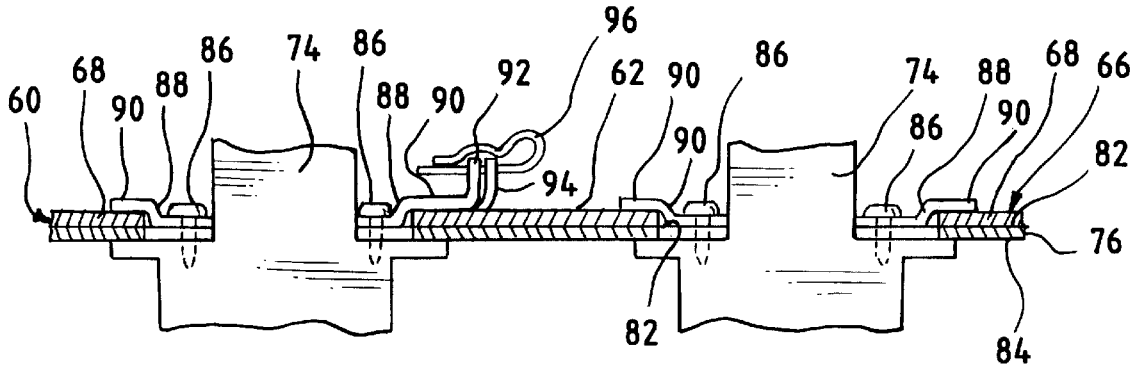
FIG. 5 illustrates a cross sectional view taken along line V—V of the assembled components illustrated in FIG. 4.

A coin slot assembly 72 is received within the lower front opening 42 beneath the intermediary bracket 60. The coin slot assembly 72 can be moved upward when installed into engagement with the intermediary bracket 60 as described below. The coin slot assembly 72 includes one or more slidable coin receiving slot mechanisms 74 assembled thereto. As can be seen in FIG. 3, the coin slot assembly 72 includes a major bracket 76 having an opening 78 corresponding to and for receiving each of the coin slot mechanisms 74. A pair of mounting brackets 80 are disposed on a back side 82 of the major bracket 76 and the coin slot mechanisms 74 are received through the openings 78 from a front side 84 of the major bracket. A number of fasteners 86 are utilized to secure the mounting brackets 80 to the coin slot mechanisms 74 with the major bracket 76 sandwiched there between.

Each of the mounting brackets 80 includes a central portion that generally rests flush against of the back side 82 of the major bracket 76 when assembled. Each of the mounting brackets 80 also includes a pair of distal ends each having a step section 88 and a flange 90 that lies generally parallel to the back side 82 of the major bracket 76 but is spaced from the backside by the step sections 88. In the present embodiment, a pair of coin receiving slots mechanisms 74 are utilized and attached to the major bracket 76. A second pair of the mounting brackets 80 are utilized to secure the second mechanism. Each mounting bracket for one mechanism is disposed transversely adjacent and spaced from a corresponding mounting bracket of the other mechanism. Therefore, the flanges 90 of laterally disposed mounting brackets face one another on the interior side of each of the mounting brackets. The opposite flanges 90 of each mounting bracket face outward.

To assemble the coin slot assembly 72 to the intermediary bracket 60, the slot assembly is inserted into the lower front opening 42 and then raised upward. The central blade section 62 of the intermediary bracket is received between the inside flanges 90 of each laterally spaced pair of mounting brackets 80. The planar edges or blades 70 of the central blade section 62 are captured by the flanges 90 on the interior sides of the mounting bracket 80. The planar blades 68 of the outer blade sections 66 are captured between the flanges 90 and the back side 82 of the major bracket 76. In this manner, the coin slot assembly 72 can then be slid upward into complete engagement with the intermediary bracket 60 to complete assembly of these two components. A pair of corresponding tabs 92 and 94 can extend, one each, from the back side of both the major bracket and the intermediary bracket. Openings can be formed in each tab 92 and 94 that align with one another when the two components are assembled. A cotter pin 96 can be inserted through the openings in the tabs 92 and 94 to secure the two components together.

A portion of the lower front opening 42 still remains uncovered. At this stage of the assembly the coin receiving basket can still be removed and inserted into the interior of the cabinet 22. This is so that the basket can be emptied without disassembling any other portion of the vending machine 20.

In order to cover the remaining open portion of the lower front opening 42, a front cover panel section 100 is provided that can be secured to the cabinet 22 in order to complete the assembly. The front cover panel 100 includes a lower edge, an upper edge and a pair of side edges. The lower edge in the present embodiment includes a flange 102 that extends from an inside surface 104 of the front cover panel 100. The flange 102 defines a space between the back surface and the flange for receiving a lip 103 carried on part of the vending machine, such as on the bottom panel 24. The front cover panel 100 when installed can be first assembled by placing the lip 103 between the flange and the back surface and then pivoting the front cover panel 100 into engagement with the cabinet 22 to cover the remaining portion of the lower front opening 42.

Figure 6:
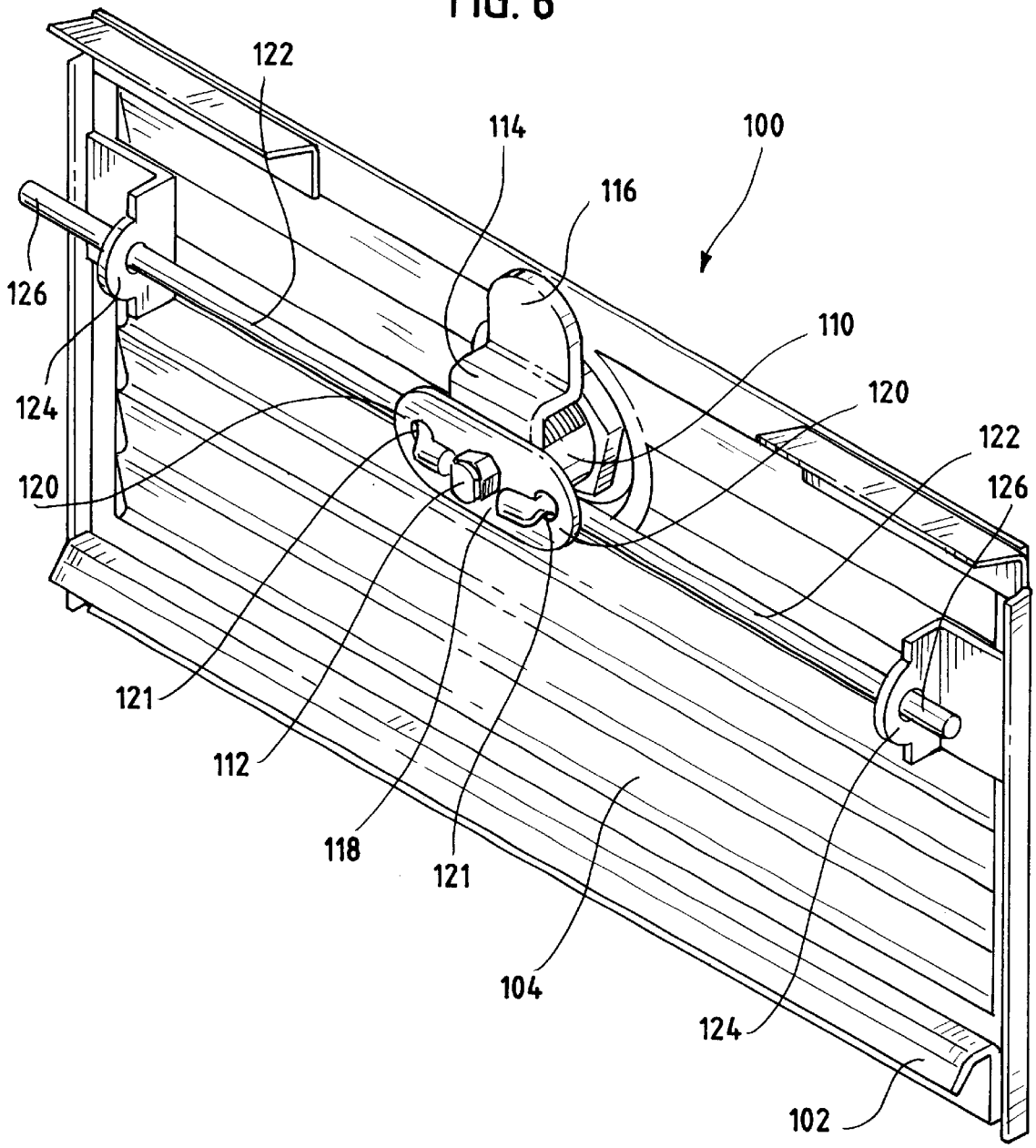
FIG. 6 illustrates a rear view of a front cover panel of the machine including a three point locking mechanism.

A three point locking mechanism 110 is carried on the back side or surface 104 of the front cover panel 100 in order to secure the cover panel to the cabinet 22. As can be seen in FIG. 6, the three point locking mechanism 110 includes a pivot 112 that can be turned by a key. A first latch link 114 is secured to the pivot 112 for rotation therewith. The latch link 114 is secured to the pivot at one end and has an opposite free end 116 that forms a lug or latch that when extended generally perpendicular to the top edge of the cover panel, extends beyond the top edge.

A second link 118 is also carried on the pivot 112 at its center. The link 118 includes a pair of opposed ends 120 wherein each end has an opening 121 therein. A latching bar 122 is received in each opening 121. Each latching bar 122 is an elongate bar that extends from a respective one of the link ends 120 to one of the side edges of the cover panel 100. A guide bracket 124 is attached near each of the side edges of the cover panel and receives a distal end 126 of a respective one of the latching bars 122 there through. As the link 118 rotates about the pivot, the ends 122 of the link, when parallel to the top edge of the cover panel, are displaced toward the side edges of the cover panel. Therefore, the latching bar 122 also move toward the side edges. In this position, the locked position, the distal ends 126 of the latching bars also define latches or lugs that extend beyond the side edges. When the link is rotated so that is generally perpendicular to the top edge of the cover panel, the link ends 120 draw each of the latching bars 122 inward toward the pivot 112. This draws the distal ends 126 of the latching bars within the side edges of cover panel. When the cover panel 100 is installed as described above, the pivot 112 of the locking mechanism 110 is rotated in such a manner so that the free ends 116 of the latch link 114 and the distal ends 126 of the latching bars 122 each extend beyond their corresponding edge of the cover panel. In this manner, the distal ends 126 and the free ends 116 are received behind or in corresponding portions or strikers of the cabinet 22 in order to secure the cover panel in place.

Figure 7:
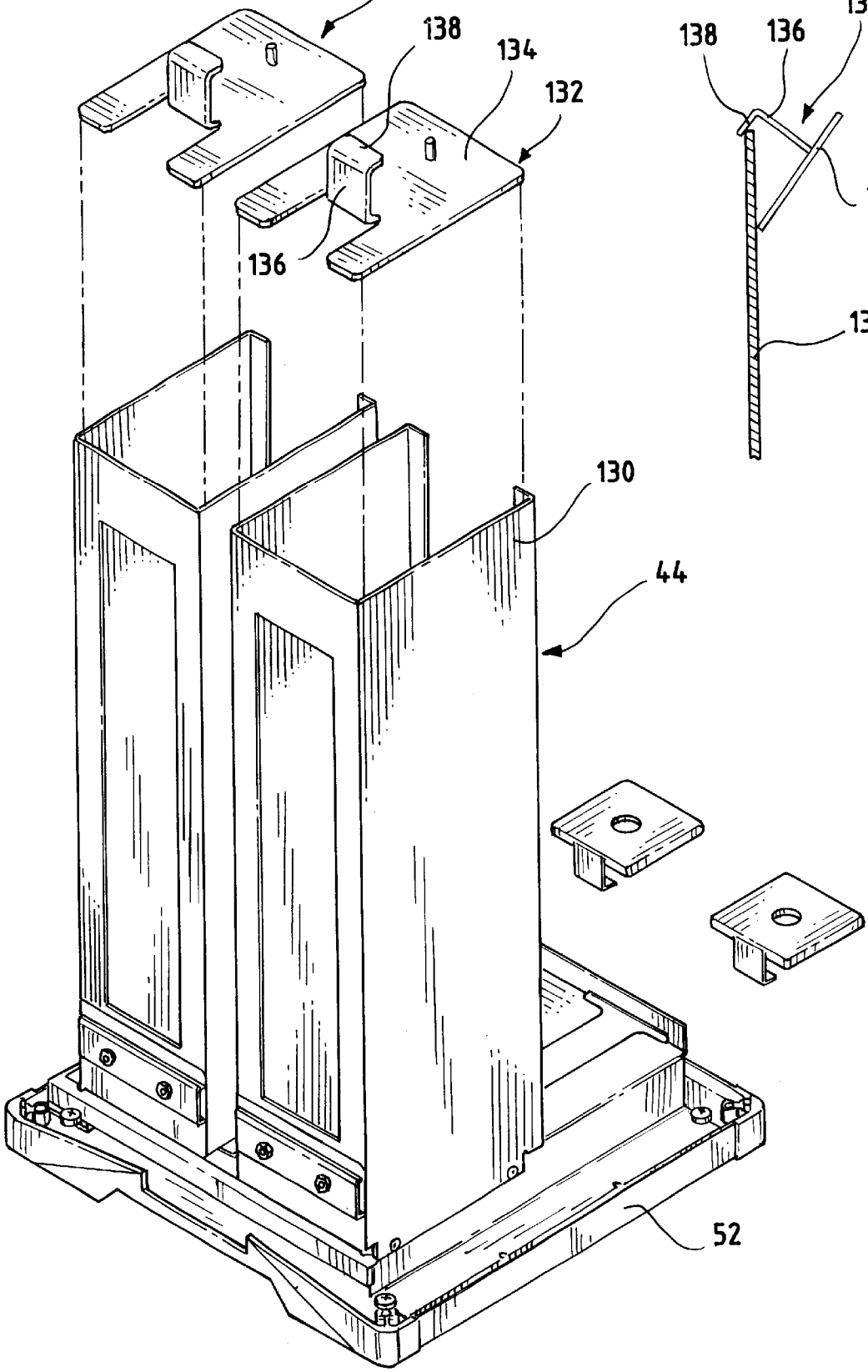
FIG. 7 illustrates one embodiment of a stack weight for placement on top of a stacked group of dispensable product within a stack of the machine.

As illustrated in FIG. 7, the hopper assembly 44 includes one or more generally tubular stacks 130 for receiving a product to be dispensed. In the present embodiment, the stacks 130 are intended to receive stickers somewhat in the form of playing cards. Each of the stacks 130 includes an interior wherein the product can be captured. A pair of stack weights 132 in the present embodiment are received in a corresponding one of the pair of stacks 130 as shown in FIG. 7. The stack weights are received within the interior of the stacks so that they may move freely along the length of stacks as the amount of product held therein changes. When one of the stacks 130 is to be refilled with more product to be dispensed by the vending machine 20, the appropriate stack weight 132 is simply removed opening in the stack 130.

Figure 8:
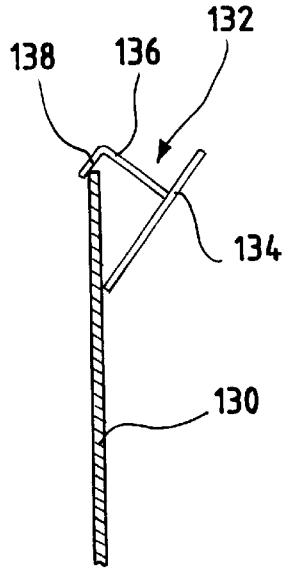
FIG. 8 illustrates the stack weight of FIG. 7 when removed from a stack of the machine and resting on an edge of the machine.

Each of the stack weights 132 includes a body plate section 134 and an upstanding finger section 136 that is disposed generally perpendicular to the plate 134. A flange 138 extends from the end of each upstanding finger section 136 and is turned at about a 90 degree angle relative to the upstanding section. Each flange 138 is intended to provide a means for an individual to grip the stack weights 132 when being removed from the stacks 130. The angled flanges 138 of each weight also assists, as is illustrated in FIG. 8, in removably securing the stack weights to a portion of the vending machine 20 when refilling the stacks 130. The upstanding finger section 136 and flange 138 acts as a hook that can be rested over an edge of either the cabinet 22 or one of the stacks 130. When each stack has been refilled with product, the stack weights can simply be lifted from the hanging position and replaced within the appropriate stack. In an alternative embodiment, the finger sections 136 can terminate at an arcuate hook that can be grasped and can be hooked to park of the vending machine.

Changes and modifications can be made to the embodiments disclosed herein. These changes are intended to fall within the scope of the present invention. Therefore, the scope of the invention is intended to be limited only by the amended claims.

What is claimed is:

1. A removable coin slot assembly for a vending machine having a bracket with at least one tongue extending therefrom, the coin slot assembly comprising:

a major bracket having a backside and at least one opening through the major bracket;

at least one coin slot mechanism received through the opening in the major bracket; and at least one mounting bracket secured on the backside of the major bracket, each mounting bracket having at least one distal end with a flange extending therefrom that is spaced from the backside for removably capturing the tongue of the vending machine bracket between the backside and the flange.

2. The coin slot assembly according to claim 1, further comprising:

a pair of the openings disposed side-by-side in the major bracket;

a pair of the coin slot mechanisms, one each received through a respective one of the openings; and at least two of the mounting brackets, one each secured to the backside of the major bracket, wherein the flanges of the mounting brackets face one another.

3. The coin slot assembly according to claim 2, further comprising:

an upper and a lower mounting bracket securing each of the coin slot mechanisms to the major bracket, each of the mounting brackets having an outer end near an edge of the major bracket and an inner end disposed between the openings in the major bracket, each end of each mounting bracket having a flange spaced from the backside of the major bracket for capturing a portion of a tongue extending from the vending machine bracket.

4. A vending machine comprising:

a cabinet having an interior and a front that is partly covered by an upper panel section and has a lower front opening below the upper panel section;

an intermediary bracket covering a portion of the lower front opening; and a coin slot assembly received in the lower front opening that releaseably engages with a portion of the intermediary bracket when installed and permitting removal of the coin slot assembly from the vending machine upon disengaging the intermediary bracket.

5. The vending machine according to claim 4, further comprising:

a removable coin collecting basket received in the lower front opening; and a securable front cover panel received in the lower front opening and covering a remaining portion of the lower front opening.

6. The vending machine according to claim 5, wherein the front cover panel further comprises:

four side edges and a back side;

a three point locking mechanism disposed on the back side and having three retractable latches, one latch corresponding to each of three of the four edges, each latch capable of engaging a portion of the vending machine when installed; and a flange on the fourth edge that engages a lip of the vending machine when installed.

7. The vending machine according to claim 4, further comprising:

an intermediate support bracket supported above a bottom panel of the cabinet; and a hopper assembly supported by the intermediate bracket.

8. The vending machine according to claim 7, wherein the intermediary bracket further comprises:

a flange extending from a top edge of a back side of the intermediary bracket that is supported by the intermediate support bracket; and a depending central blade section and a pair of flanking blade sections spaced from the central blade section, each blade section extending downward and engaging a portion of the coin slot assembly.

9. The vending machine according to claim 4, wherein the coin slot assembly further comprises:

at least one mounting bracket disposed on a back side of a major bracket and securing the coin slot assembly to the major bracket, wherein the mounting bracket has a pair of distal ends and a flange on each of the distal ends that is spaced from a back side of the major bracket, and wherein each flange captures a portion of the intermediary bracket between the flange and the back side of the major bracket when installed.

10. The vending machine according to claim 9, wherein the coin slot assembly further comprises:

a pair of the coin slot mechanisms laterally spaced apart from one another and received through openings in the major bracket; and at least a pair of the mounting brackets laterally spaced apart, one each securing a respective one of the coin slot mechanisms to the major bracket.

11. The vending machine according to claim 10, wherein the coin slot assembly further comprises:

an upper and a lower mounting bracket securing each of the pair of coin slot mechanisms to the major bracket, wherein the upper mounting brackets are laterally spaced from one another and each have one of the flanges defining an inner flange that faces the inner flange of the other upper mounting bracket, and wherein the lower mounting brackets are laterally spaced from one another and each have one of the flanges defining an inner flange that faces the inner flange of the other lower mounting bracket.

12. The vending machine according to claim 11, wherein the intermediary bracket further comprises:

a central blade section having a pair of planar side edges, one of the edges being captured by the inner flanges of one upper and one lower mounting bracket, and the other of the edges being captured by the inner flanges of the other upper and lower mounting bracket.

13. The vending machine according to claim 12, wherein the intermediary bracket further comprises:

a pair of blade sections flanking the central blade section, each having a planar inner edge, wherein the planar inner edges are each captured by an outer flange of one of the upper mounting brackets and one of the lower mounting brackets.

14. The vending machine according to claim 4, further comprising:

a tab having an opening and extending from a back side of a major bracket of the coin slot assembly:

a corresponding tab having an opening and extending from a back side of the intermediary bracket; and a cotter pin received through both of the openings of the tab and corresponding tab when the coin slot assembly is assembled to the intermediary bracket.

15. The vending machine according to claim 4, further comprising:

a hopper assembly stored within the cabinet and having at least one stack for receiving a vertically stacked plurality of dispensable products; and a stack weight removably received within the at least one stack and having a body and an upstanding finger section adapted to hook onto a portion of the vending machine when removed from the stack.

16. The vending machine according to claim 15, wherein each stack weight further has a flange extending from and at an angle relative to the upstanding finger section defining a hook on a top surface of the body of the stack weight.

17. A stack weight for a vending machine having a hopper assembly and at least one stack that can contain a plurality of vertically stacked products to be dispensed by the machine, the stack weight comprising:

a main body suited to accommodate resting on a top of the vertically stacked product in the stack, the main body having a top surface;

an upstanding section extending from the top surface of the main body; and a flange extending from the upstanding section, the flange and the upstanding section together defining a hook that can be used as a grip to remove and replace the stack weight within the stack, and can be used for hanging the stack weight from a portion of the vending machine when refilling the stack.

18. The stack weight according to claim 17, wherein the upstanding section and the flange are disposed at a right angle relative to one another.

19. The stack weight according to claim 18, wherein the flange is arcuate and extends from the upstanding section to define the hook.

20. A method of refilling a vending machine having a hopper assembly and at least one stack that can contain a plurality of vertically stacked products to be dispensed by the machine, the method comprising:

providing a stack weight having a bottom surface, a top surface, and a hook extending from the top surface, the bottom surface resting on a top of the vertically stacked products;

grasping the hook;

lifting the stack weight from the stack;

hanging the stack weight by the hook from a portion of the vending machine;

adding more product to the stack; and replacing the stack weight on the top of the vertically stacked products.

* * * * *